United States Patent [19]

Ciarcia et al.

[11] 4,276,526

[45] Jun. 30, 1981

[54] MINIATURE CURRENT LIMITING CIRCUIT BREAKER

[75] Inventors: Ronald D. Ciarcia, Plantsville; Robert L. Owens, Plainville, both of Conn.

[73] Assignee: General Electric Company, New York, N.Y.

[21] Appl. No.: 115,636

[22] Filed: Jan. 23, 1980

[51] Int. Cl.[3] ..... H01H 75/12

[52] U.S. Cl. ..... 335/35; 335/16; 335/23

[58] Field of Search ..... 335/23, 35, 38, 16, 335/24, 22, 36, 170, 174, 21, 173; 200/147 R

[56] References Cited

U.S. PATENT DOCUMENTS

| | | | |
|---|---|---|---|
| 3,483,343 | 12/1969 | Heft | 200/147 R |
| 3,581,253 | 5/1971 | Beaudoin et al. | 335/16 |
| 4,071,836 | 1/1978 | Cook et al. | 335/16 |
| 4,220,935 | 9/1980 | Wafer et al. | 335/38 |

*Primary Examiner*—Harold Broome

*Attorney, Agent, or Firm*—Robert A. Cahill; Walter C. Bernkopf; Philip L. Schlamp

[57] ABSTRACT

A miniature current limiting circuit breaker incorporates double break circuit interrupting contacts capable of being abruptly separated by a high fault current responsive solenoid acting to first trip the breaker mechanism and then forcibly effect contact separation. The arc chamber is constructed to achieve enhanced blowout of the arc into the arc chute and to develop gas pressures acting to accelerate contact separation. The circuit breaker is trip-free and includes both thermal tripping and internal common tripping capabilities.

27 Claims, 13 Drawing Figures

MINIATURE CURRENT LIMITING CIRCUIT BREAKER

BACKGROUND OF THE INVENTION

The present invention relates to miniature molded case circuit breakers of the type utilized in residential, office and light industrial applications principally for branch circuit protection and particularly to molded case circuit breakers capable of achieving a current limiting circuit interruption.

As the current availables of electrical utilities are raised, increasing emphasis is being placed on the magnitude of energy let-through a circuit is subjected to when a circuit protective device, such as a circuit breaker, acts to interrupt high fault currents. Energy let-through, expressed by the equation $I^2t$, where (I) is current and (t) is time, represents the true damage potential to the circuit and its connected loads associated with a high fault current interruption. It has been proposed that a maximum energy let-through value be adopted as one criteria qualifying circuit breakers for certain circuit applications.

Obviously, the ideal approach to minimizing energy let-through during a high fault current interruption is to limit the current (I). An exceptionally fast acting circuit breaker capable of effecting early contact separation and then developing an arc voltage greater than the system driving voltage such as to crest a fault current wavefront at a level well below its prospective peak amplitude, serves this goal. However, this is not the complete answer, since time (t), the interval from the onset of a fault current wave to final arc extinction, should also be minimized. This requires optimization of the arc chamber and arc chute designs, not only to rapidly develop the requisite high arc voltage, but also to achieve a full and final arc quench as quickly as possible.

It is accordingly an object of the present invention to provide a molded case circuit breaker capable of significantly limiting the let-through energy accompanying a high fault current interruption.

A further object is to provide a molded case circuit breaker of the above character which is capable of true current limiting operation.

Another object is to provide a molded case circuit breaker of the above character having improved arc extinguishing capabilities.

Yet another object is to provide a molded case circuit breaker of the above character which is efficient in construction and reliable in operation.

Other objects of the invention will in part be obvious and in part appear hereinafter.

SUMMARY OF THE INVENTION

In accordance with the present invention there is provided a miniature, molded case current limiting circuit breaker capable of exceedingly fast tripping action effective in limiting to acceptable levels and let-through energy incident with a high fault current interruption. To achieve this, the circuit breaker incorporates double break circuit interrupting contacts consisting of a pair of stationary contacts bridged by a pair of movable contacts carried by a shuttle slidingly mounted within the breaker case for movement between open and closed positions. Conductive straps route current to and away from the stationary contacts in a manner to provide enhanced electromotive forces acting on the arcs drawn between the two sets of stationary and movable contacts to create a single elongated arc which is then effectively propelled out into the arc chute, pursuant to rapidly developing a high arc voltage. The arc chamber is structured such that the gases associated with these arcs are effective to both blow the arcs out into the arc chute and utilize the associated gas pressure to accelerate the opening movement of the shuttle.

The current strap feeding one of the stationary contacts runs directly to a line terminal, while the other current strap connects the other stationary contact to one end of an elongated U-shaped bimetal pivotally mounted by a breaker mechanism frame. The angular position of the bimetal is adjustably established by a spring biasing the bimetal against the tip of a calibrating screw. A braid connects the other end of the bimetal to one end of a close wound trip solenoid coil; the other end coil being connected to a load terminal completing the breaker internal circuit.

An elongated arm, pivotally mounted at essentially its mid-length by the mechanism frame, carries a latch bar adjacent one end, while its other end engages the movable contact shuttle. A tension spring biases the arm in the pivotal direction to force the shuttle to its open circuit position. A manual operating handle, slidingly mounted by the frame, cooperates with the mechanism frame in pivotally mounting one end of a latch lever. A latch shoulder, formed in the latch lever intermediate its ends, engages the latch bar to operatively connect the handle with the arm such that sliding movement of the handle between its ON and OFF positions pivotally articulates the arm in a manner to slidingly translate the shuttle between its closed and open circuit positions, respectively.

Also pivotally mounted by the mechanism frame is a trip lever. One end of this trip lever is poised in the path of deflection of the bimetal, while the other trip lever end is positioned to engage the free end of the latch lever. Thus thermal tripping of the circuit breaker in response to an overload condition is effected by the pivotal movement of the trip lever induced by the bimetal deflection; such pivotal movement causing unlatching of the latch lever from the latch bar to thereupon enable the tension spring to pivotally articulate the arm in the direction to propel the movable contact shuttle to its open circuit position.

To achieve a current limiting, high fault current interruption, the plunger of the trip solenoid is structured to act on both the trip lever and the arm. That is, as the plunger is pulled from its extended position to its retracted position by the electromagnetic attraction resulting from the flow of fault current through the trip solenoid coil, the plunger first picks up the trip lever to unlatch the latch lever from the latch bar and then picks up the arm to pivot same in the direction to abruptly slide the shuttle from its closed to its open circuit position. This trip solenoid propulsion of the movable contacts achieves contact separation in significantly shorter time than when sole reliance for contact separation is placed on the tension spring.

The invention accordingly comprises the features of construction, combination of elements and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings, in which.

Corresponding reference numerals refer to like parts throughout the several views of the drawings.

DETAILED DESCRIPTION

Figure 1:
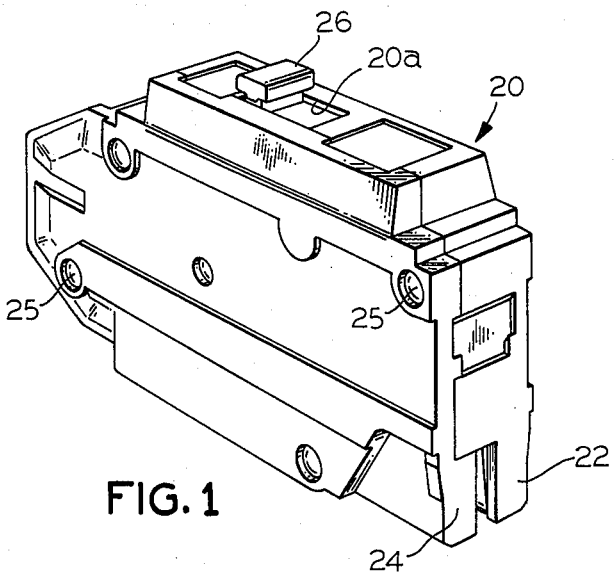
FIG. 1 is a perspective view of a molded case circuit breaker embodying the present invention.

The circuit breaker of the present invention is seen in FIG. 1 as including a molded case, generally indicated at 20, consisting of a base 22 and a cover 24 secured together by suitable means such as rivets 25. Slideably mounted within the breaker case and protruding through a top opening 20*a* therein is a manual operating handle 26 facilitating digital articulation of the circuit breaker between its ON and OFF conditions.

Figure 6:
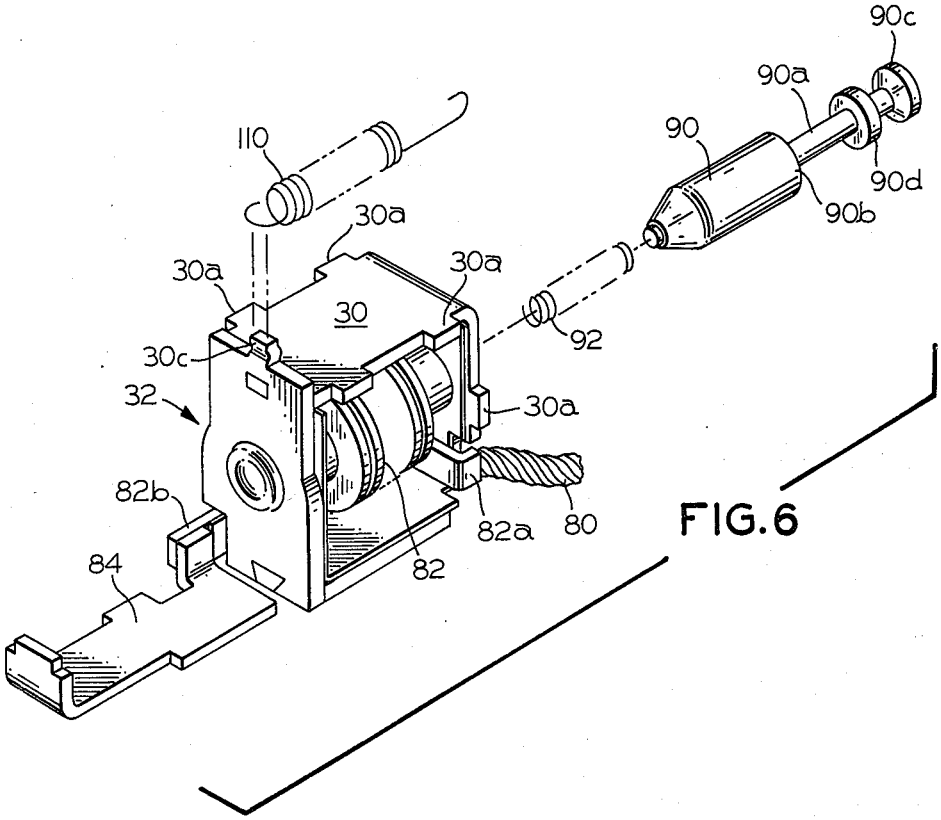
FIG. 6 is a perspective view of the trip solenoid utilized in the circuit breaker of FIG. 1.
Figure 2:
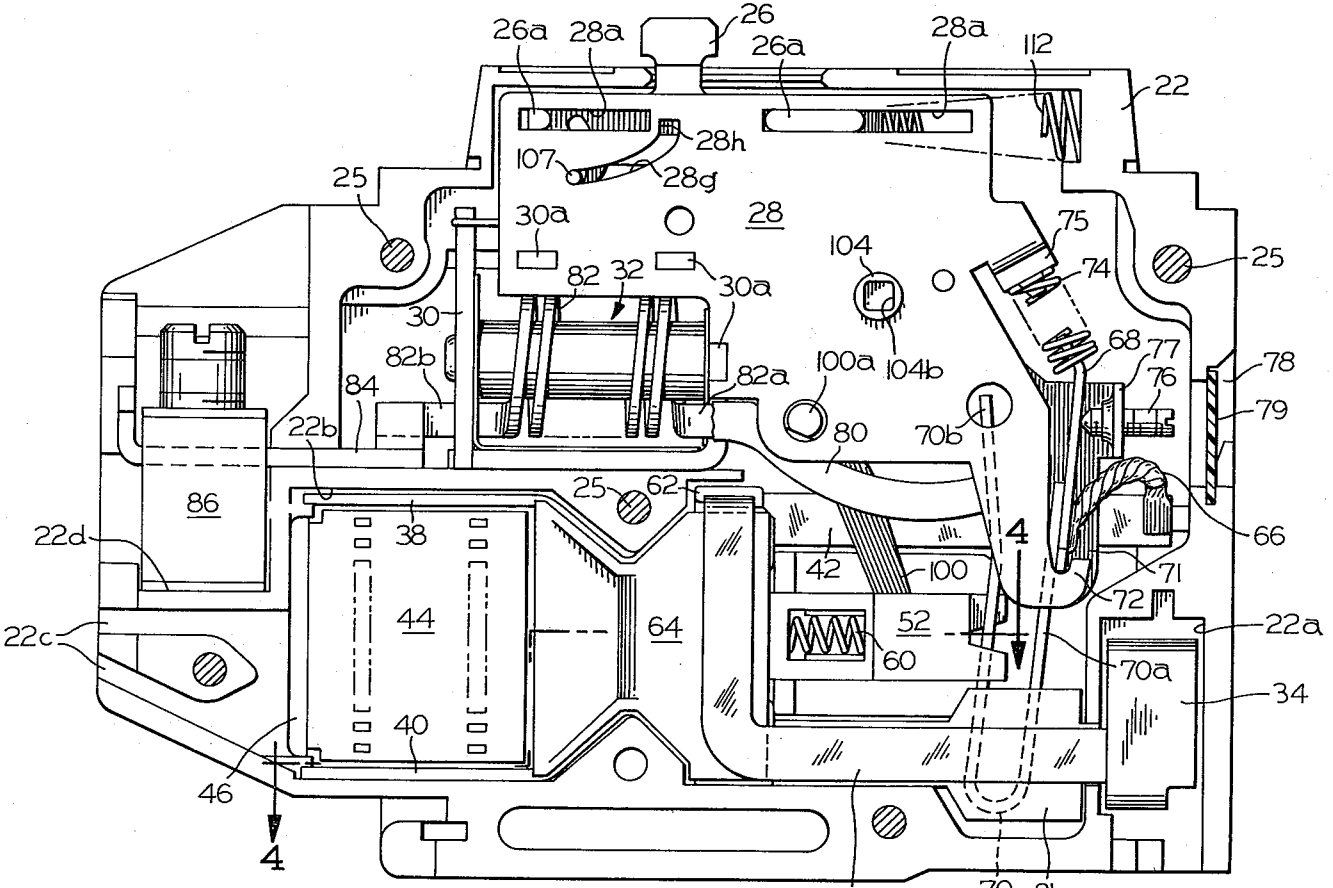
FIG. 2 is a side elevational view, with the case cover removed, of the circuit breaker of FIG. 1.
Figure 5:
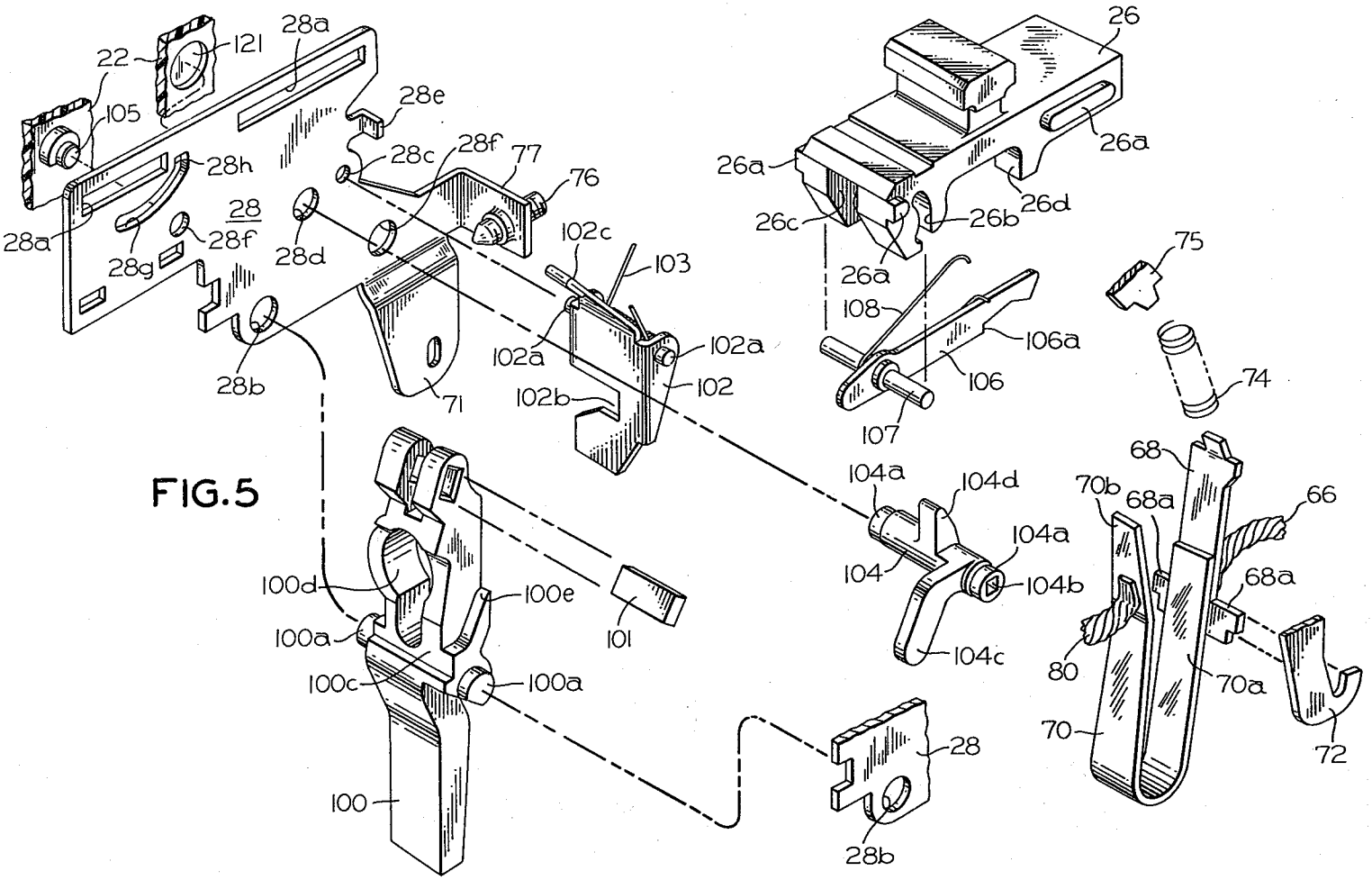
FIG. 5 is an exploded assembly view of the operating and trip mechanism components utilized in the circuit breaker of FIG. 1.

Turning to FIG. 2, base 22 and cover 24 are structured to positionally mount a mechanism frame consisting of a pair of sideplates 28 which are suitably apertured to receive tangs 30*a* integrally formed with a magnetic frame 30 of a trip solenoid assembly, generally indicated at 32 and seen in perspective in FIG. 6. These tangs are staked to secure the frame sideplates in parallel spaced relation. Handle 26, seen also in FIG. 5, is integrally formed with opposed laterally extending lugs 26*a* which are received in opposed longitudinally elongated slots 28*a* formed in the sideplates pursuant to slideably mounting the handle.

Figure 3:
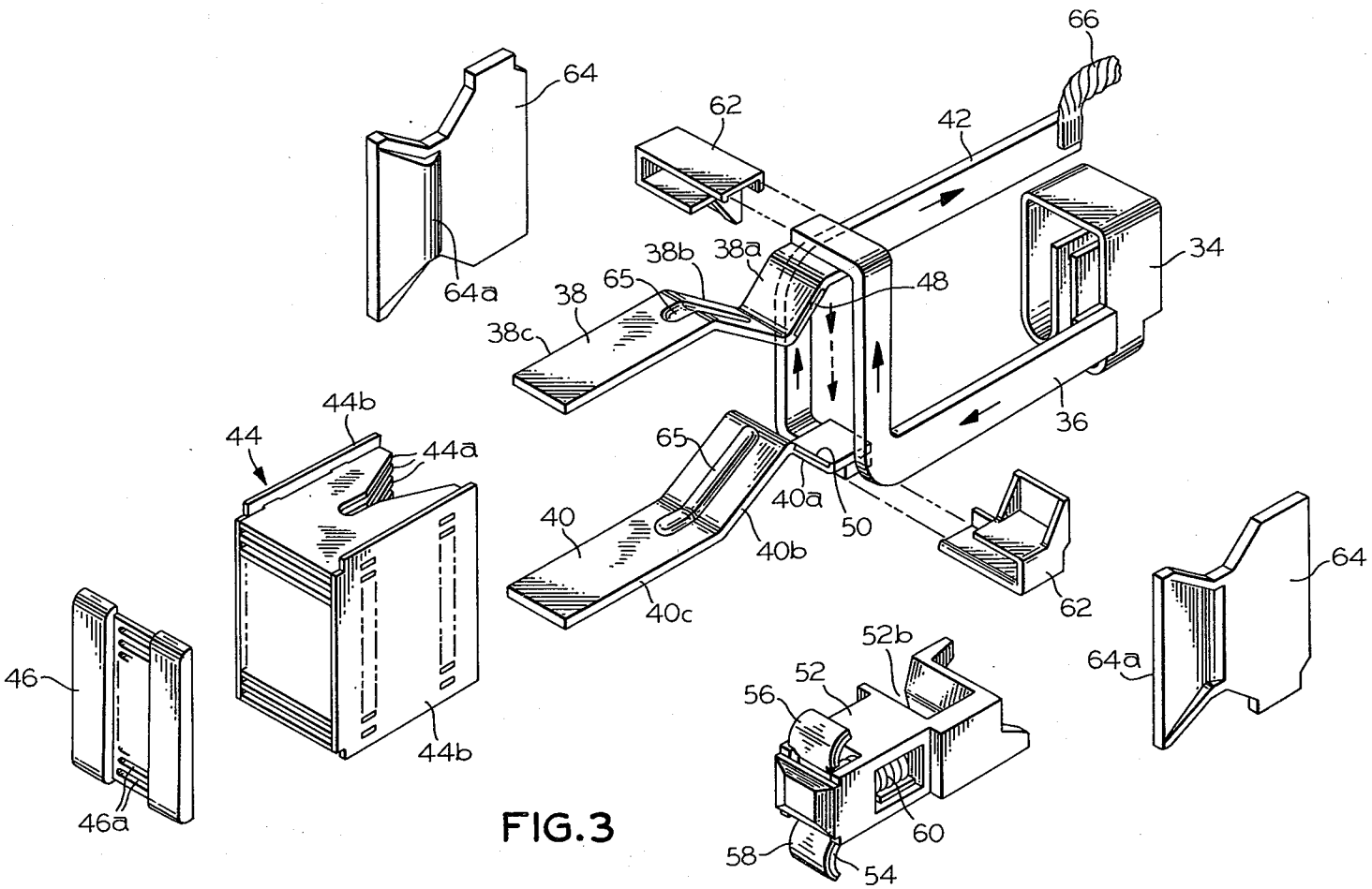
FIG. 3 is an exploded assembly view of the current carrying and arc handling components utilized in the circuit breaker of FIG. 1.

Referring jointly to FIGS. 2 and 3, a line terminal femal stab connector 34 is accommodated in a cavity 22*a* formed in base 22 adjacent its lower right corner. A generally L-shaped line strap 36 has its right outer end welded in electrical connection with connector 34. From this connector strap 36 extends longitudinally adjacent the bottom of base 22 and then vertically adjacent the inner side of cover 24. The inner end of this line strap, as best seen in FIG. 3, terminates in a laterally extending portion welded in electrical connection with a longitudinally extending arc runner 38 disposed along the upper side of an arc chamber 22*b* molded into base 22. Disposed along the lower side of the arc chamber is a second, opposing longitudinally elongated arc runner 40 whose right end is welded in electrical connection with the laterally turned terminal portion of an L-shaped current strap 42. From its laterally turned termination, this current strap extends vertically along the base sidewall and then longitudinally to its other termination adjacent the line end of the breaker case.

Arc runners 38 and 40, as best seen in FIG. 3, are configured in complementing fashion to provide mutually converging segments 38*a* and 40*a*, followed by mutually diverging segments 38*b* and 40*b*, and concluding parallel, spaced segments 38*c* and 40*c* between which is positioned an arc chute 44. This arc chute consists of a multitude of identical, metallic arc plates 44*a* held in closely spaced parallel relation between opposed, insulative sideplates 44*b*. A baffle 46, positioned against the back side of the arc chute, is formed of insulative material having a series of laterally elongated slots 46*a* in registry with the gaps between arc plates 44*a*. Beyond arc chamber 22*b*, base 22 is formed to provide suitable venting, as indicated at 22*c* in FIG. 2.

Figure 7:
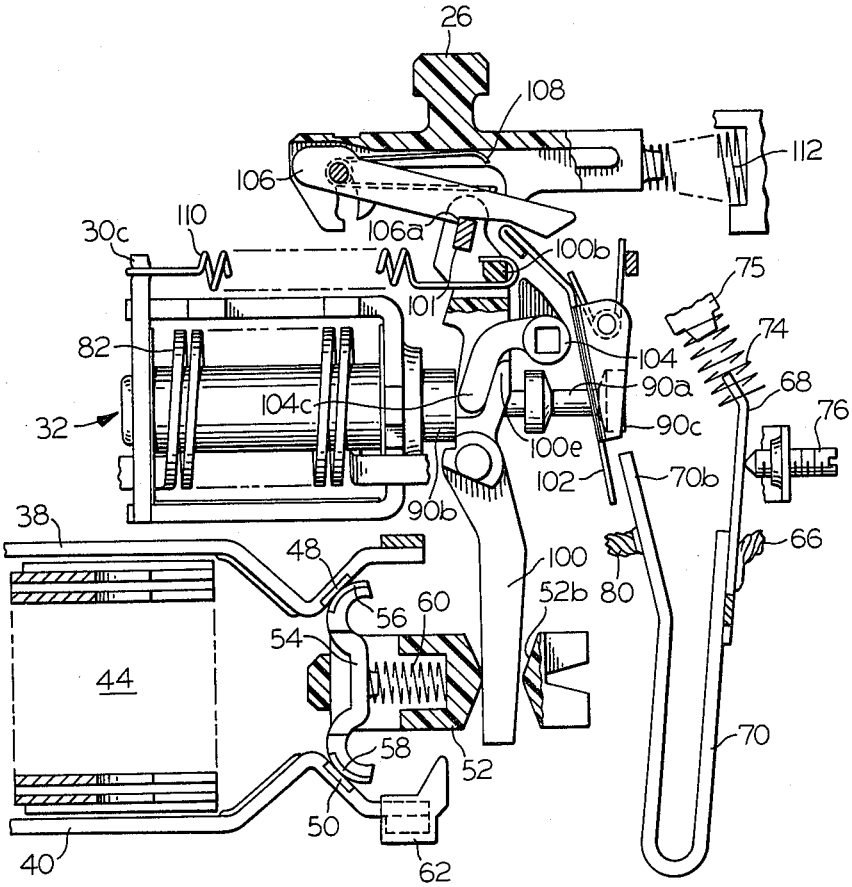
FIG. 7 is a fragmentary side elevational view, with the case and mechanism frame eliminated, of the circuit breaker of FIG. 1, as seen in its ON or closed circuit condition.

Still referring to FIG. 3, a first stationary contact 48 is inlaid in converging segment 38*a* of arc runner 38, while a second stationary contact 50 is inlaid in the converging segment 40*a* of arc runner 40. A shuttle 52, molded of insulative plastic, is slidingly mounted by the base and cover for reciprocating longitudinal movement. The forward or left end portion of this shuttle is formed with an open interior having opposed, upper and lower openings thereinto accommodating the receipt of an electrically conductive bridging member 54. Inlaid in the curved terminal portions of this bridging member exposed above and below shuttle 52 are movable contacts 56 and 58, respectively. As best seen in FIG. 7, when shuttle 52 is in its left-most, closed circuit position, movable contacts 56 and 58 respectively engage stationary contacts 48 and 50, thereby electrically connecting line strap 36 with current strap 42. A compression spring 60, accommodated in the open interior of the shuttle acts on bridging member 54 to insure adequate contact pressure when the shuttle assumes its closed circuit position.

Figure 4:
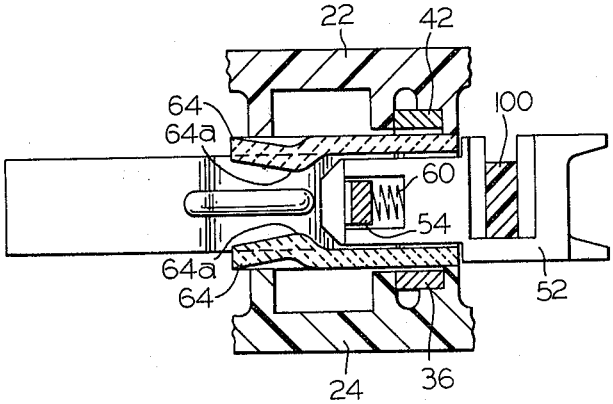
FIG. 4 is a sectional view taken along line 4—4 of FIG. 2.

Completing the description of those parts seen in FIG. 3, molded plastic insulators 62 are fitted over the laterally turned portions of straps 36 and 42 and the terminations of arc runners 38 and 40 respectively electrically connected thereto pursuant to insuring electrical isolation between the contiguous portions of these current straps which are at different electrical potentials during a circuit interruption and while the circuit breaker is open. As also seen in FIG. 4, ceramic members 64 are positioned inside the vertical runs of current straps 36 and 42 to flank the contact region where arcs are drawn as the movable contacts are separated from their associated stationary contacts during a circuit interruption. These members are formed having surface conformations 64*a* contoured to provide, together with arc runners 38 and 40, a venturi throat for creating gas pressure differentials effective in forcing the two arcs drawn between the two sets of stationary and movable contacts into a single arc extending between the arc runners which is then propelled out into the arc chamber. Also effective in propelling this single arc out into the arc chamber is the physical relationship thereto of the vertical runs of current straps 36 and 42. As taught in commonly assigned U.S. Pat. No. 3,483,343, the currents flowing in these vertical runs create electrodynamic forces which act to "motor" the arc out into the arc chamber. The arc runners are provided with opposed longitudinal ribs 65 which serve to center the arc foot-prints as the arc encounters arc chute 44 where it is finally extinguished.

The right end of current strap 42, as seen in FIG. 2, is connected by a braid 66 to a conductive bracket 68, which, in turn, is welded in electrical connection with the upper end of one leg 70*a* of a U-shaped bimetal 70. As best seen in FIG. 5, bracket 68 is formed having opposed, laterally extending arms 68*a*; one being received in an aperture provided in a depending extension 71 formed with one frame sideplate 28 and the other resting in a crotch formed in a depending extension 72 formed with the other frame sideplate. It is thus seen that bimetal 70 is pivotally mounted to the mechanism frame. A compression spring 74 acts between a laterally turned extension 75 of one sideplate 28 and the upper end of bracket 68 to bias bimetal 70 in the clockwise direction (FIG. 2) to an angular position determined by the abutment of the bracket with the tip of a calibrating screw 76 adjustably threaded through a laterally turned extension 77 of the other frame sideplate. As will be seen, adjustment of this calibrating screw, facilitated by the provision of a window 78 formed in base 22 which is normally closed off by an insulative insert 79, selectively positions the upper end of the other bimetal leg 70*b* pursuant to establishing the desired thermal trip response characteristics of the circuit breaker to overload currents. An insulative strip 81, seen in FIG. 2, isolates the lower portion of bimetal 70 from the longitudinal run of line current strap 36.

Figure 10:
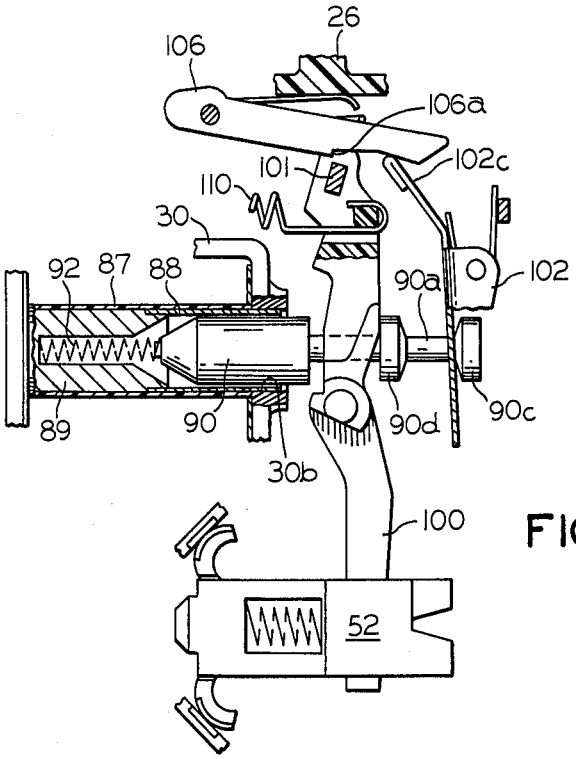
FIG. 10 is a fragmentary side elevational view depicting electromagnetic tripping of the circuit breaker of FIG. 1.

The upper end of bimetal leg 70*b* is electrically connected by an insulatively covered braid 80, seen in FIGS. 2, 5 and 6, to one end 82*a* of a coil 82 included in trip solenoid assembly 32. This coil is preferably closely wound to minimize magnetic flux leakage. The other end 82*b* of this coil is electrically connected to the inner end of a load strap 84 whose outer end portion is embraced by an externally accessible wire lug 86 accommodated in a recessed portion 22*d* of base 22. As seen in FIG. 10, coil 82 surrounds an insulative tube 87 which, in turn, embraces a stainless steel sleeve 88 and a magnetic pole piece 89 mounted by magnetic frame 30. A plunger 90 is slidingly received in sleeve 88 and is normally biased by a light compression spring 92 out through an opening 30*b* in frame 30 to an extended position.

Figure 8:
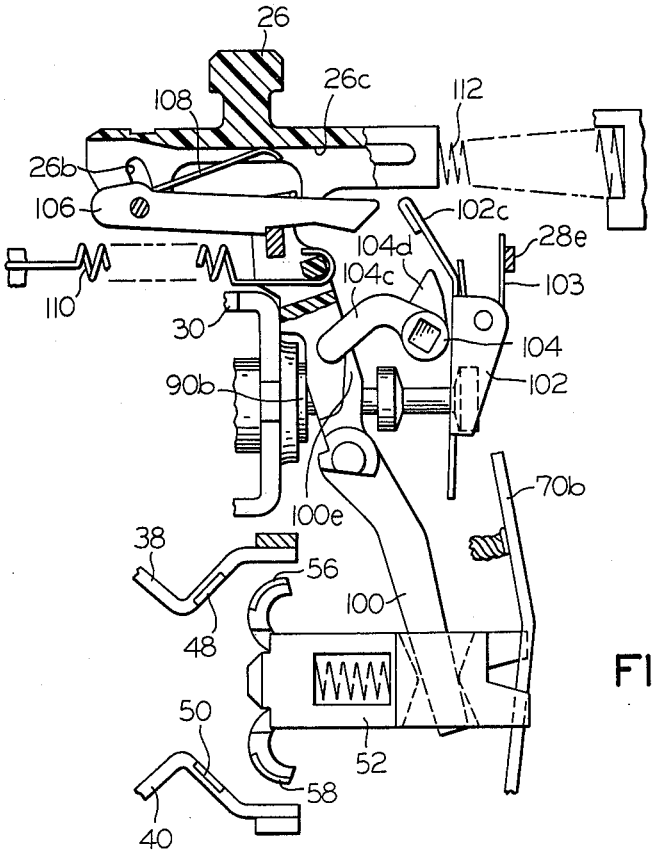
FIG. 8 is a fragmentary side elevational view, with the case and mechanism frame removed, of the circuit breaker of FIG. 1, as seen in its manually operated OFF or open circuit condition.

The operating mechanism of the subject circuit breaker, seen in explosion in FIG. 5, includes a movable contact operating arm 100 having opposed, laterally extending trunnions 100*a* which are received in holes 28*b* formed in sideplates 28 pursuant to pivotally mounting this arm to the mechanism frame. A latch bar 101 is carried by this arm adjacent its upper end. Also partially mounted to the mechanism frame are a trip lever 102, having a pin 102*a* whose terminations are received in laterally aligned sideplate holes 28*c*, and an internal common trip lever 104, having opposed trunnions received in laterally aligned sideplate holes 28*d*. Trip lever 102 is equipped with a torsion spring 103 having one end engaging a laterally turned tab 28*e* carried by one of the sideplates 28 such as to bias the trip lever in the counterclockwise pivotal direction, as seen in FIG. 8. Additional sideplate holes, such as those seen at 28*f*, receive outstanding posts, one seen at 105 in FIG. 5, molded into the base and cover pursuant to positionally locating the mechanism frame within the breaker case.

Still referring to FIG. 5, a latch lever 106 carries a transverse pivot pin 107 which operates in a vertically oriented laterally extending arcuate shaped groove 26*b* molded into the underside of the body of handle 26. The groove is intersected by a longitudinally extending notch 26*c* molded into the underside of the handle body for the purpose of accommodating the longitudinal extent of latch lever 106. A hairpin spring 108 biases the free end of this latch lever downwardly. The terminations of pin 107 are received in laterally aligned, generally arcuate slots 28*g* formed in the sideplates. The reason for this unique pivotal mounting of latch lever 1–6 will be explained below.

The circuit breaker is seen in FIG. 7 in its ON condition with handle 26 in its right-most position and shuttle 52 in its left-most position bringing the two sets of stationary and movable contacts into engagement. This is achieved by the coupling of the handle with contact operating arm 100 normally afforded by latch lever 106. That is, the lower edge of the latch lever is relieved to provide a latch shoulder 106*a* which normally engages latch bar 101 carried by the upper end of arm 100. Thus, when the handle is positioned to its right-most ON position, the latch lever, pivotally connected thereto, pivots arm 100 to its clockwise-most position, in the process swinging leftward its lower end, which is received in a side opening slot 52*b* in shuttle 52 (FIG. 3). The shuttle is thus propelled to its closed circuit position by manually sliding the handle to its right-most ON position. This ON condition of the breaker is rendered stable by the provision of detent shoulders 28*h* provided in the uppermost terminal portions of arcuate sideplate slots 28*g*. These shoulders are created by abruptly terminating these arcuate slots in short vertically oriented slot segments. It is thus seen that when latch lever 106 is moved rightward by handle 26, the terminal portions of the latch lever pivot pin 107 move rightward through arcuate sideplate slots 28*g* into the vertically oriented slot segments thereof where they come into engagement with these vertically oriented detent shoulders 28*h*. This detenting engagement sustains the breaker in its ON condition against the bias of a charged contact opening tension spring 110 having its right end hooked to a transverse rib 100*b* formed in the upper end of arm 100 and its left end hooked to an upstanding tab 30*c* carried by magnetic frame 30 of trip solenoid assembly 32.

To manually open the circuit breaker handle 26 is moved leftward. During the initial increment of this leftward movement, arcuate slot 26*b* in the handle body acts on latch lever pivot pin 107 to cam its terminal portions off of detent shoulders 28*h* and down into arcuate portions sideplate slots 28*g*. Spring 110 can then discharge to propel arm 100 in the counter-clockwise direction, abruptly jerking shuttle 52 to its open circuit position and the latch lever-handle combination to a left-most OFF position, all as seen in FIG. 8. It will be noted that if handle 26 is simply pushed away from its rightward ON position without being held, spring 110 is free to abruptly discharge, in the process effecting contact separation in quick-break fashion. Upon visual comparison of the breaker closed condition of FIG. 7 and the breaker open condition of FIG. 8, it will be noted that the latching engagement of latch shoulder 106*a* carried by latch lever 106 and latch bar 101 carried by contact operating arm 100 is not disturbed during manual operation of the breaker between its open and closed conditions. In fact, by virtue of the shifting of the pivotal mounting location of latch lever 106 during manual breaker operation afforded by the operation of its pivot pin 107 in sideplate slots 28*g* and handle slot 26*b*, the angular relationship between the latch lever and the contact operating arm 100 is maintained essentially constant as these parts articulate between their breaker closed and breaker open positions. Consequently, the character of the latching engagement between latch shoulder 106*a* and latch bar 101 is likewise maintained essentially constant during manual breaker operation, thus insuring against unintended unlatching or tripping of the circuit breaker.

Figure 9:
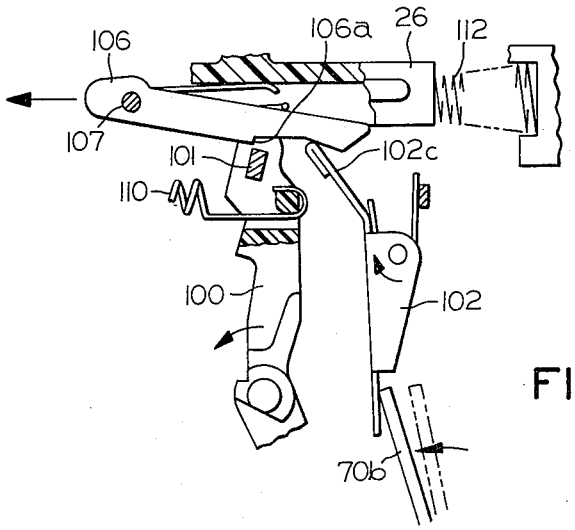
FIG. 9 is a fragmentary side elevational view depicting thermal tripping of the circuit breaker of FIG. 1.

To accommodate thermal tripping of the circuit breaker, the lower terminal portion of trip lever 102 is depended into confronting relation with the upper termination portion of bimetal leg 70*b*, as seen in FIG. 7. A side opening slot 102*b* (FIG. 5) formed in this trip lever receives a stem 90*b* (see also FIG. 6) carried by trip solenoid plunger 90 whose extended position assumed under the bias of spring 92 (FIG. 10) is determined by the abutment of plunger body 90*b* against a flattened surface portion 100*c* of arm 100 (FIG. 7) located immediately above its pivotally mounting trunnions 100*a*. Plunger spring 92 is sufficiently light so that this engagement of the plunger with the arm does not disrupt the arm's latching engagement with latch lever 106. Plunger stem 90*a* carries at its free end an annular flange 90*c* against which trip lever 102 is abutted by its torsion spring 103 to establish the trip lever's quiescent position. As seen in FIG. 9, the response of bimetal 70 to overload current results in leftward deflection of the upper end of bimetal leg 70*b*, in process picking up and pivoting trip lever 102 in the clockwise direction. The trip lever carries an angularly upstanding finger 102*c* which then swings rightwardly to pick up and elevate the free end of latch lever 106. Latch shoulder 106*a* is thus disengaged from latch bar 101, freeing spring 110 to discharge and thereby effect abrupt separation of the breaker contacts. It is seen that until the bimetal cools down and thus reverts to its normal configuration, trip lever 102 maintains latch lever 106 elevated out of latching engagement with arm 100 during rightward movement of the handle-latch lever combination to discourage attempts to turn the breaker ON. When latch lever 106 is disengaged from arm 100, a handle return spring 112, seen in FIGS. 2, 7 and 8, discharges to propel the handle-latch lever combination to its left-most OFF position. Should the contacts be welded and thus fail to separate under the urgence of spring 110 when the breaker is tripped, the upper end of contact operating arm 100 remains in its closed circuit position to encounter lugs 26*d* (FIG. 5) depending from the handle body to impede movement of handle 26 to its left-most OFF position under the bias of spring 112. Thus, the handle remains in its rightward, ON indicating position even though the breaker has been tripped. In most instances, a contact weld can be broken by forcibly moving the handle to its OFF position. From FIG. 7 it is seen that adjustment of calibrating screw 76 varies the spacing between the upper end of trip lever 102 pursuant to establishing the desired thermal trip characteristics of the circuit breaker.

To accommodate electromagnetic tripping of the circuit breaker, solenoid plunger stem 90*a* carries an intermediate annular flange 90*d* which, together with flange 90*c*, is inserted through the enlarged portion of a keyhole opening 100*d* in arm 100 (FIG. 5) to permit receipt of solenoid plunger stem 90*a* in the depending reduced portion thereof. With plunger 90 in its extended position seen in FIG. 7, flange 90*d* is positioned in closely spaced relation to the right side of the contact operating arm. In response to a high fault current wavefront flowing through trip solenoid coil 82, plunger 90 is magnetically attracted leftwardly. Plunger flange 90*c* first encounters trip lever 102, pivoting it clockwise to initiate unlatching of latch lever 106 from arm 100, as seen in FIG. 10. As latching shoulder 106 clears latch bar 101, plunger flange 90*d* picks up arm 100, abruptly pivoting it in the counter-clockwise direction to jerk shuttle 52 to its open circuit position. Since the trip solenoid plunger acts directly on arm 100 at a point closely spaced from its pivot axis, contact separation is achieved earlier in time than would be the case if spring 110 acted alone.

As in the case of thermal tripping of the circuit breaker, when the latch lever is unlatched from the arm, spring 112 returns the handle-latch lever combination to its left-most OFF position. When current flow through the breaker has been interrupted, spring 92 returns plunger 90 to its right-most, extended position. Since latch lever 106, in its extreme leftward position is beyond the reach of trip lever finger 102*c* as seen in FIG. 8, the trip lever 102 can be returned to its quiescent position by its torsion spring 103. Hairpin spring 108 biases latch lever 106 downwardly to position its shoulder 106*a* into intercepting relation with latch bar 101. While not shown in FIG. 8, the fully OFF position of arm 100 is determined by its engagement with magnetic frame 30, which incidentally produces retraction of plunger 90 against the bias of spring 92, is such that, with the handle-latch lever combination biased to its fully OFF position by spring 112, latch lever shoulder 106*a* is spaced somewhat to the left of latch bar 101. That is, the edge of the latch lever to the right of the latching shoulder rests on the latch bar with the arm and latch lever in their fully OFF positions. Consequently, assurance is provided that the latch lever will always pick up the arm and thus effect contact closure as the handle is shifted from its OFF position to its ON position. It will also be noted that the circuit breaker is trip free since handle 26 is decoupled from arm 100 when the breaker is tripped. Consequently, manual retention of the handle in its ON position does not impede contact separation initiated either by the bimetal or the trip solenoid.

Figure 11:
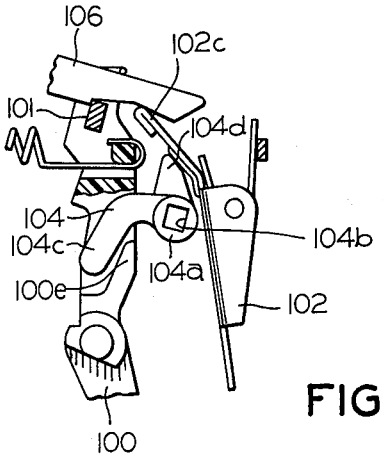
FIG. 11 is a fragmentary side elevational view depicting internal common tripping of the circuit breaker of FIG. 1.
Figure 12:
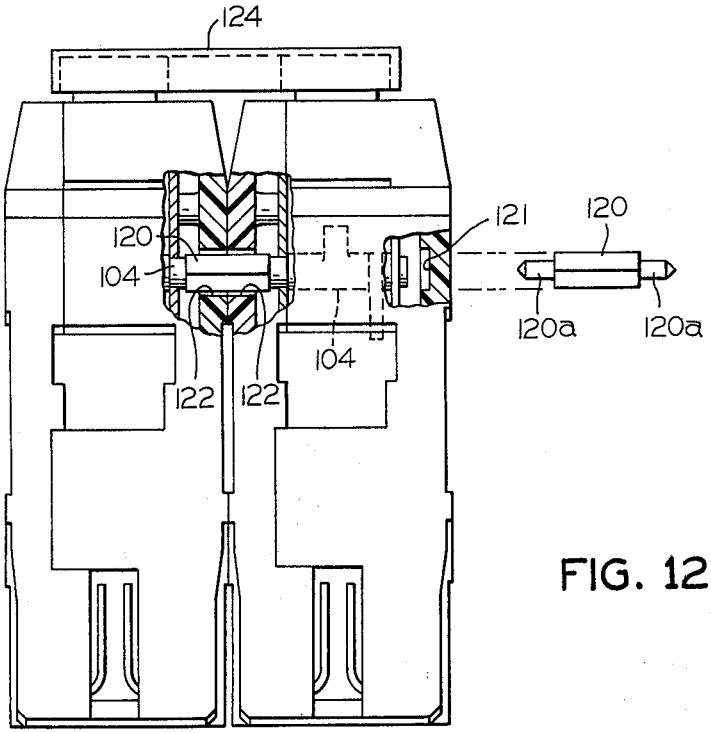
FIG.12 is an end view, partially broken away, of a pair of circuit breakers of FIG. 1 ganged together in side-by-side relation.
Figure 13:
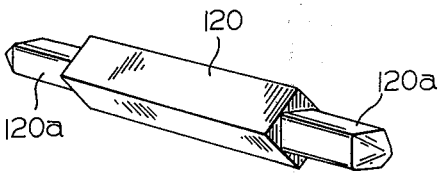
FIG. 13 is a perspective view of the internal common trip coupler trippingly inter-coupling the circuit breaker pair of FIG. 12.

To accommodate internal common tripping of two or more circuit breakers of the present invention ganged together in side-by-side relation in the manner illustrated in FIG. 12, the common trip levers 104 in each breaker are tied together by a common trip coupler 120 seen in perspective in FIG. 13. Knockouts, one seen at 121 in FIG. 5, in the confronting base and cover sidewalls of contiguous breakers are removed to create register openings 122 through which coupler 120 extends. The terminations 120*a* of the coupler are square-sided for receipt in mating sockets 104*b* (FIG. 5) provided in the ends of common trip lever trunnions 104*a*, pursuant to uniting the common trip levers 104 in the breakers for unitary pivotal movement. As seen in FIGS. 7, 8 and 11, each common trip lever includes a depending finger 104*c* and an upstanding nose 104*d*. The finger is disposed in engaging relation with a shoulder 100*e* molded into one side of contact operating arm 100 (see also FIG. 5). Nose 104*d*, on the other hand, is disposed in engaging relation with the underside of finger 102*c* carried by trip lever 102. From FIG. 8, it is seen that when one of the breakers is tripped either thermally or magnetically in response to an overcurrent condition, contact separating pivotal movement of the tripped breakers arm 100 swings shoulder 100*e* thereof in the counterclockwise direction, picking up finger 104*c* to rotate common trip lever 104 of the tripped breaker in the clockwise direction. From FIG. 11, it is seen this produces corresponding clockwise pivotal motion of the common trip levers in the other breakers, resulting in the noses 104*d* thereof engaging and pivoting the associated trip levers 102. The fingers 102*c* thereof elevate the associated latch levers 106 to commonly trip their associate breakers. Thus, overcurrent tripping of one of the circuit breakers precipitates tripping of all other circuit breakers whose common trip levers are ganged together with the common trip lever of the initially tripped circuit breaker by couplers 120. It is noted that manual operation of the circuit breaker to its OFF condition will result in clockwise pivotal movement of its common trip lever. However, leftward movement of the latch lever incident to manual opening of the circuit breaker is sufficient to position it beyond the reach of trip lever finger 102*c* when he trip lever is pivoted in the clockwise direction by the action of common trip lever 104. Thus, the common trip lever does not disturb the latching engagement between latch shoulder 106*a* and latch bar 101 during manual circuit breaker operation. The same situation prevails in the other breakers whose common trip levers are ganged together by couplers 120 if their handles 26 are manually operated in concert. This is readily achieved by the provision of an external handle tie 124 seen in FIG. 12.

From the foregoing description, it is seen that the circuit breaker of the present invention is capable of a current limiting high fault current interruption. The features contributing to this current limiting operation are the early contact separation achieved by the direct acting trip solenoid 32, together with the rapidly ensuing development of an arc voltage in excess of the fault current driving voltage, i.e., the system voltage. This is achieved in part by the utilization of double break contacts. That is, immediately upon contact separation, two anode-cathode voltage drops are developed in opposition to the system voltage rather than one such drop when single break contacts are employed. As the contact gaps increase, the two arcs are elongated, thereby increasing the arc voltage. At the point when the combined arc gaps exceed the separation between the opposed junctions between the converging-diverging segments of arc runners 38 and 40, the two arcs convert to a single arc drawn between these opposed junctions. Since, as previously mentioned, shuttle 52 opening movement is effected with great speed, the arc footpoints do not linger on the stationary and movable contacts, thus minimizing contact degradation. Moreover, since the initial arc pair is drawn early in a fault current wavefront before the current reaches an excessive magnitude, this single arc is relatively small in cross-section and thus more readily motivated out into the arc chamber. The single arc progresses rapidly out into the arc chamber and is further elongated by the diverging arc runner segments to further increase arc voltage. As this elongated arc comes under the magnetic attraction of the arc plates, it is drawn into the arc chute to then be broken up into individual arclets drawn between adjacent arc plates which are preferably of a greater number than normally utilized. Each arclet imposes its associated anode-cathode voltage drop in opposition to the system voltage; the net result being to develop an arc voltage in excess of the system voltage effective in forcing a premature current zero. The cooling and deionizing effects of the arc chute insure final arc extinction without restrike.

Incidentally, it should be mentioned that the lower extremity of trip lever 102 is preferably insulatively coated to prevent the establishment of a parallel current through the mechanism frame shunting the bimetal when the bimetal deflects into engagement with the trip lever.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. A circuit breaker comprising, in combination:

A. a molded insulative case consisting of a base and a cover;

B. a manual operating handle mounted within said case for movement between ON and OFF positions;

C. a mechanism frame positionally mounted in said base;

D. at least one stationary contact positionally mounted in said base;

E. at least one movable contact;

F. an elongated movable contact operating arm movably mounted by said frame, one end of said arm operatively coupled with said movable contact such that movement of said arm in a closing direction propels said movable contact into engaging relation with said stationary contact and movement of said arm in an opposite, opening direction propels said movable contact away from engaging relation with said stationary contact;

G. a spring continuously biasing said arm for movement in said opening direction;

H. a latch element carried by the other end of said arm;

I. an elongated, pivotal latch lever coupled with said handle and having a latching shoulder latchingly engaging said latch element to translate the movement of said handle between its ON and OFF positions into movement of said arm in said closing and opening directions to effect manual breaker operation, said handle cooperating with said frame to vary the pivotal mounting location of said latch lever pursuant to maintaining its angular relationship with said arm essentially constant during manual breaker operation; and J. trip means acting on said latch lever to disengage said latching shoulder from said latch element in response to current of overcurrent proportions flowing through the engaged stationary and movable contacts, whereby to decouple said handle from said arm and permit opening movement of said arm by said spring independently of said handle.

2. The circuit breaker defined in claim 1, wherein there are two sets of engageable stationary and movable contacts, said circuit breaker further including a conductive bridging member mounting the two movable contacts, and a shuttle slidingly mounted within said case and coupled with said one end of said arm for reciprocating movement between contact engaged and contact disengaged positions.

3. The circuit breaker defined in claim 2, wherein said arm is pivotally mounted intermediate its ends by said frame.

4. The circuit breaker defined in claim 2, which further comprises arc handling means including an arc chute disposed in an arc chamber formed in said case and a pair of arc runners situated along opposed sides of said arc chamber, said stationary contacts being mounted by opposed, mutually converging segments of said arc runners located intermediate said shuttle and said arc chute.

5. The circuit breaker defined in claim 4, which further comprises a separate current strap rigidly electrically connected to each said arc runner, said current straps including segments extending generally transversely to said arc runners for disposal along opposed sides of said shuttle at locations beyond said arc chamber.

6. The circuit breaker defined in claim 5, wherein said arc handling means further includes separate ceramic inserts disposed intermediate said current strap segments and said shuttle and extend in opposed spaced relation into said arc chamber, said inserts cooperating with said arc runners to create an entryway into said arc chamber in the general shape of a venturi throat.

7. The circuit breaker defined in claim 1, wherein said trip means includes a trip solenoid having a coil conducting the current flowing through the engaged stationary and movable contacts and a plunger normally biased to an extended position, and a primary trip lever mounted by said frame for pivotal movement from a quiescent position into tripping engagement with said latch lever to disengage said latching shoulder from said latch element, said plunger operatively coupled with said trip lever and said arm such that magnetic retraction thereof in response to the flow of fault current through said coil first pivots said trip lever into tripping engagement with said latch lever and then propels said arm in said opening direction.

8. The circuit breaker defined in claim 7, wherein said trip means further includes a common trip lever pivotally mounted by said frame and adapted for pivotal coupling with the common trip lever of an associated circuit breaker of like construction, said common trip levers of both circuit breakers being operatively coupled with their respectively associated movable contact operating arms and primary trip levers such as to pivot said primary trip levers into tripping engagement with said latch levers in response to opening movement of said arms.

9. The circuit breaker defined in claim 7, wherein said trip means further includes a bimetal conducting the current flowing through the engaged stationary and movable contacts, said bimetal operating to pivot said trip lever into tripping engagement with said latch lever in response to the conduction of overload current therethrough.

10. The circuit breaker defined in claim 9, wherein said bimetal is U-shaped and is pivotally mounted adjacent the free end of one leg thereof to said frame so as to dispose the free end of the other leg thereof in operative relation with said trip lever.

11. The circuit breaker defined in claim 10, wherein said trip means further includes a calibrating screw adjustably threaded through a portion of said frame and a spring biasing said bimetal against the tip of said calibrating screw to establish a desired angular orientation of said bimetal.

12. The circuit breaker defined in claim 1, wherein said latch lever is provided adjacent one end with a pivot pin adjustably mounted for rotation at the intersection of arcuate slots formed in said handle and said frame, said frame slot being formed having a detent shoulder against which said pivot pin is engaged to releaseably sustain the engagement of said stationary and movable contacts against the bias of said spring.

13. The circuit breaker defined in claim 12, wherein there are two sets of engageable stationary and movable contacts, said circuit breaker further including a conducting bridging member mounting the two movable contacts, and a shutter slidingly mounted within said case and coupled with said one end of said arm for reciprocating movement between contact engaged and contact disengaged positions.

14. The circuit breaker defined in claim 13, which further comprises arc handling means including an arc chute disposed in an arc chamber formed in said case and a pair of arc runners situated along opposed sides of said arc chamber, said stationary contacts being mounted by opposed, mutually converging segments of said arc runners located intermediate said shuttle and said arc chute.

15. The circuit breaker defined in claim 14, which further comprises a separate current strap rigidly electrically connected to each said arc runner, said current straps including segments extending generally transversely to said arc runner for disposal along opposed sides of said shuttle at locations beyond said arc chamber.

16. The circuit breaker defined in claim 15, wherein said arc handling means further includes separate ceramic inserts disposed intermediate said current strap segments and said shuttle and extend in opposed spaced relation into said arc chamber, said inserts cooperating with said arc runners to create an entryway into said arc chamber in the general shape of a venturi throat.

17. The circuit breaker defined in claim 16, wherein said trip means includes a trip solenoid having a coil conducting the current flowing through the engaged stationary and movable contacts and a plunger normally biased to an extended position, and a primary trip lever mounted by said frame for pivotal movement from a quiescent position into tripping engagement with said latch lever to disengage said latching shoulder from said latch element, said plunger operatively coupled with said trip lever and said arm such that magnetic retraction thereof in response to the flow of fault current through said coil first pivots said trip lever into tripping engagement with said latch lever and then propels said arm in said opening direction.

18. The circuit breaker defined in claim 17, wherein said trip means further includes a common trip lever pivotally mounted by said frame and adapted for pivotal coupling with the common trip lever of an associated circuit breaker of like construction, said common trip levers of both circuit breakers being operatively coupled with their respectively associated movable contact operating arms and primary trip levers such as to pivot said primary trip levers into tripping engagement with said latch levers in response to opening movement of said arms.

19. The circuit breaker defined in claim 18, wherein said trip means further includes a bimetal conducting the current flowing through the engaged stationary and movable contacts, said bimetal operating to pivot said trip lever into tripping engagement with said latch lever in response to the conduction of overload current therethrough.

20. A circuit breaker comprising, in combination:

A. a molded insulative case consisting of a base and a cover;

B. a manual operating handle mounted within said case for movement between ON and OFF positions;

C. a mechanism frame positionally mounted in said base;

D. a pair of stationary contacts positionally mounted within said base;

E. a pair of movable contacts carried by a conductive bridging member;

F. a shuttle mounting said bridging member and slidingly mounted within said case for reciprocating movement between a closed position with said stationary and movable contacts in respective engaging relation and an open position with said stationary and movable contacts in disengaged relation;

G. an elongated movable contact arm pivotally mounted intermediate its ends by said frame, one end of said arm operatively coupled with said shuttle such that pivotal movement of said arm in a contact engaging direction propels said shuttle to its closed position and pivotal movement of said arm in an opposite, disengaging direction propels said shuttle to its open position;

H. a spring continuously biasing said arm in said disengaging direction;

I. a latch element carried by the other end of said arm;

J. an elongated latch lever cooperatively pivotally mounted by said handle and said frame, said latch lever having a latching shoulder normally latchingly engaging said latch element to translate the movement of said handle between its ON and OFF positions into pivotal movement of said arm in said engaging and disengaging directions, respectively, to effect manual breaker operation;

K. a primary trip lever mounted by said frame for pivotal movement from a quiescent position into tripping engagement with said latch lever effective in decoupling said handle from said arm, whereby said arm is pivoted by said spring in said contact disengaging direction; and L. a trip solenoid having a coil conducting the current flowing through the engaged stationary and movable contacts and a plunger normally biased to an extended position, said plunger operatively coupled with said primary trip lever and said arm such that magnetic retraction thereof in response to the flow of fault current through said coil first pivots said primary trip lever into tripping engagement with said latch lever and then propels said arm in said contact disengaging direction.

21. The circuit breaker defined in claim 20, which further comprises arc handling means including an arc chute disposed in an arc chamber formed in said case and a pair of arc runners situated along opposed sides of said arc chamber, said stationary contacts being mounted by opposed, mutually converging segments of said arc runners located intermediate said shuttle and said arc chute.

22. The circuit breaker defined in claim 21, which further comprises a separate current strap rigidly electrically connected to each said arc runner, said current straps including segments extending generally transversely to said arc runner for disposal along opposed sides of said shuttle at locations beyond said arc chamber.

23. The circuit breaker defined in claim 22, wherein said arc handling means further includes separate ceramic inserts disposed intermediate said current strap segments and said shuttle and extend in opposed spaced relation into said arc chamber, said inserts cooperating with said arc runners to create an entryway into said arc chamber in the general shape of a venturi throat.

24. The circuit breaker defined in claim 23, wherein said trip means further includes a common trip lever pivotally mounted by said frame and adapted for pivotal coupling with the common trip lever of an associated circuit breaker of like cosntruction, said common trip levers of both circuit breakers being operatively coupled with their respectively associated movable contact operating arms and primary trip levers such as to pivot said primary trip levers into tripping engagement with said latch levers in response to opening movement of said arms.

25. The circuit breaker defined in claim 24, wherein said trip means further includes a bimetal conducting the current flowing through the engaged stationary and movable contacts, said bimetal operating to pivot said primary trip lever into tripping engagement with said latch lever in response to the conduction of overload current therethrough.

26. The circuit breaker defined in claim 25, wherein said bimetal is U-shaped and is pivotally mounted adjacent the free end of one leg thereof to said frame so as to dispose the free end of the other leg thereof in operative relation with said trip lever.

27. The circuit breaker defined in claim 26, wherein said latch lever is provided adjacent one end with a pivot pin adjustably mounted for rotation at the intersection of arcuate slots formed in said handle and said frame, said frame slot being formed having a detent shoulder against which said pivot pin is engaged to releaseably sustain said shuttle in its closed position.

* * * * *